US005993106A

United States Patent [19]

Huang

[11] Patent Number: 5,993,106

[45] Date of Patent: Nov. 30, 1999

[54] RESTRAINABLE MANHOLE COVER, HANDHOLE COVER AND THE OPEN/CLOSE DEVICE THEREWITH

[76] Inventor: Chun Chieh Huang, No. 195, Yuan-Chi Rd., Hsin-Min Tsun, Ming-Chien Hsiang, Nan-Tou Hsien, Taiwan

[21] Appl. No.: 09/050,193

[22] Filed: Mar. 30, 1998

[51] Int. Cl.[6] ..... E02D 29/14; B66D 1/00

[52] U.S. Cl. ..... 404/26; 404/25; 254/264; 212/901

[58] Field of Search ..... 404/25, 26; 254/264; 187/244; 212/901

[56] References Cited

U.S. PATENT DOCUMENTS

| | | | |
|---|---|---|---|
| 911,256 | 2/1909 | McWane | 404/25 |
| 1,738,556 | 10/1929 | Beagle | 404/25 |
| 1,887,965 | 11/1932 | Stoner | 212/901 |
| 3,501,874 | 3/1970 | Hahne | 404/25 |
| 4,861,186 | 8/1989 | Ferns | 404/25 |
| 5,454,625 | 10/1995 | Christensen et al. | 298/18 |
| 5,458,435 | 10/1995 | Kohno | 404/25 |
| 5,462,385 | 10/1995 | Mohlengraft | 404/25 |

*Primary Examiner*—Robert E. Pezzuto
*Assistant Examiner*—Gary S. Harsmann
*Attorney, Agent, or Firm*—Raymond Y. Chan; David and Raymond

[57] ABSTRACT

A restrainable manhole, handhole cover and open/close device therewith provides vertical pads at predetermined positions along a bottom edge of a manhole/handhole cover, which are integrally molded with a cover body. This forms an inclined a third edge which is longer than an inner diameter of a manhole/handhole neck such that it can prevent the cover body to bounce up and displace when being overlaid by a vehicle. Furthermore, a plurality of pre-molded flat plates are provided on predetermined locations perpendicular to the neck. A pre-punched hole is provided for each flat plate for accepting the vertical pad of the cover body for restraining the cover body in its position at the same time the cover body is overlaid by a vehicle.

10 Claims, 19 Drawing Sheets

RPIOR ART

RPIOR ART

RESTRAINABLE MANHOLE COVER, HANDHOLE COVER AND THE OPEN/CLOSE DEVICE THEREWITH

BACKGROUND OF THE INVENTION

1. Field of the invention

The present invention relates to a restrainable manhole (or handhole) cover and the open/close device therewith, and more particularly to a manhole (or handhole, it may be represented only by manhole thereinafter) cover with a structure which can retain the cover in its position even overlaid or hit by a heavy object as a vehicle, and a cover open/close device which can be used to hang up and remove the manhole cover promptly, conveniently and easily.

2. Description of the Prior Art

In a modern and highly congested city, lots of public facilities, such as electrical power lines, communication wires, and sewer system are installed underground, either in respective underground duct, tunnel, or in a commonly used ductway. Manholes and handholes are therefore required to be built in proper location along the roadway for installation of the necessary equipment, pulling cables, routine inspection and maintenance. As the manhole covers are installed on the surface of the pavement, they are exposed to the danger of being overlaid or hit by heavy vehicles and displaced or even destroyed entailing the severe problems of public security. Some drawbacks of conventional manhole covers experienced in the past are enumerated hereinafter:

1. As being overlaid day and night for a long duration, a manhole cover is gradually worn out and reduces its thickness, and finally cracks. As a replaced new cover and the remaining manhole neck are not formed of the same mold so that the existence of excessive horizontal and vertical clearances between the manhole cover and neck can not be prevented.
2. If the quality of sand used to form the mold for making the manhole cover is poor due to its uniform granular size. The contact surface between the cover and the neck will not be smooth but with an excessive vertical clearance.
3. A manhole cover is deformed due to unappropriate treatment in controlling its temperature during its manufacturing process in sand molding.
4. Imperfect sample test for finished products allows some unqualified products, especially with excessively deviated size, to be considered as qualified.
5. A manhole cover is not properly returned to its original place with some clay or gravels interlaid between the manhole cover and the manhole neck by careless workmanship by installation or maintenance personnel.
6. A particular portion on a manhole cover is overlaid by vehicle wheels in case the manhole is built under the passage of vehicles. That portion of the manhole cover together with that of the manhole neck will wore out severely than other portions. If the manhole cover is not returned exactly to its original position with respect to the manhole neck after opening, cover and neck never keep close matching with each other to make the surface of the manhole cover flat and horizontal with the pavement.

All of the six factors mentioned above will cause a bounce or a displacement of a manhole cover when it is overlaid or hit by a vehicle, or even cracked or whirling away causing danger to public.

A severest highway traffic accident happened on Jan. 23, 1989 was a typical example. A heavy track overlaid a cast iron manhole cover installed on the vehicle passage of Chung Shin Bridge connecting Taipei City with Taipei County. It was a manhole cover for communication duct system. However, the cover bounced up and removed from its position after being hit, which caused a following large passenger bus to stumble over the uncovered manhole and overturned. Unfortunately, the overturning bus collided a car coming from opposite direction just at that moment and caused four persons died who were riding on the car.

The inventor of the present invention investigated the above accident carefully from every angle, the conclusion is described in detail as follows:

According to the design control and criteria concerning Highway Bridge recommended by American Association of State Highway and Transportation Officials (AASHTO), a shaft distance between front and rear wheels for a typical track $\overline{Dd}$ is 4.25 m, if running speed is 60 km/hr, the diameter of manhole cover $\overline{RF}$ is 0.676 m, the overlaying begins at the instant, $\Sigma T\ \overline{dR}=0$, where $\overline{dR}\geqq 0$. the time required for the front wheel to pass over from the rear end R to front end F of the manhole cover will be:

$$T_{\overline{RF}}=\overline{RF}/\upsilon=0.676\text{ m}/(60\times 1000\text{ m/hr})\times 60\times 60=0.04056\text{ sec.}$$

the time required for the rear wheel of the track to reach the rear end R of the manhole will be $$\overline{TDR}=(\overline{Dd}-\overline{RF})/M=(4.25\text{ m}-0.676\text{ m})/(60\times 1000\text{ m/hr})\times 60\times 60=0.21444\text{ sec.}$$

At the beginning of overlaying, $T_{\overline{dR}}=0$, the manhole cover was supposed to be at its normal position as shown in FIG. 1, and supposing that the manhole cover was not installed exactly vertically, yet tilted slightly with its front end F uprightly aparted from its correct position with a vertical clearance $H_1$, from top surface of the manhole neck as shown in FIG. 2. After the time $T_{\overline{RF}}=0.0405$ sec. elapsed the front wheel reached point F, the front end of the manhole cover. As the point F was already apart from the manhole neck with a clearance $H_1$, an instantaneous impact of the wheel made the rear end R of the cover to jump up with a clearance $H_2$ which being larger than $H_1$ ($H_2>H_1$) . As the front wheel was about to leave the point F, part of the vehicle weight was exerted on the front end of the manhole cover aparting already a vertical clearance $H_1$ from its normal position. This second impact would further enlarge upright clearance $H_2$ of the rear end of the cover. The manhole cover displayed a flip flop action as shown in FIG. 3. Finally at the moment $T_{\overline{DR}}=0.214$ sec. when the rear wheel hit the rear end R of the cover, the cover was entirely removed resulting in a severe traffic accident as described above (Referring to FIG. 4).

Further referring to FIGS. 5 through 9, due to a pulling force or compressive force exerted by the vehicle to the manhole cover, the manhole cover might remove from its position by turning counter-clockwise. The suspected state was as follows:

As shown in FIG. 5, doe to a clearance existing between the manhole cover and neck, when the front wheel of the vehicle overlaid one end of the manhole cover, the other end would jump up. As the wheel exerted a pulling force or a compressive force on the manhole cover, the cover obtained a moment of counter clockwise rotation, at this time highest point of jumped up cover also turned in counter clockwise direction as shown in FIG. 6. At the moment the front wheel overlaid rear end of the cover, the highest point of the cover would move right rearward while it was already over the ground as shown in FIG. 7. After the front wheel had passed through, the cover still kept turning upward by its own inertia as shown in FIG. 8 According to the above calculation, the time required for the rear wheel to reach the rear end R of the cover was $T_{\overline{DR}}$=0.214 sec. Apparently in such a short time, the rear wheel would definitely hit the rear end of the flying cover with so huge impact force that threw the cover in right forward direction as shown in FIG. 9.

From the above description, it should be understood that there is still room for improving the design of conventional manhole covers. The inventor of the present invention disclosed a solution to solve the existing problems in conventional products and acquired a patent of R.O.C. by patent No. ZL96207779.8.

Through a consistent effort, the inventor discloses the present invention hereinafter which is more practicable and effective than the former one.

SUMMARY OF THE INVENTION

It is an object of the present invention to provide a restrainable manhole or handhole cover which can be installed safely, reliably to prevent the occurrence of traffic accident by removing it by passing vehicles.

It is another object of the present invention to provide an open/close device for a restrainable manhole or handhole cover, which device can be used to open and remove the manhole cover rapidly, conveniently and easily.

To achieve these and other objects, the present invention provides vertical pads at proper positions along the bottom edge of a manhole or handhole cover to be formed at the same time with the cover in molding process. This forms an inclined third edge which is longer than the inner diameter of a manhole or handhole neck such that it can prevent the cover to bounce up and displace when being overlaid by a vehicle.

Furthermore, a plurality of pre-molded flat plates are provided on appropriate locations perpendicular to a manhole or handhole neck, and a pre-punched hole is provided for each flat plate for accepting the vertical pad of the cover for restraining the cover in its position at the time the cover is overlaid by a vehicle.

The present invention further provides an time saving, labor saving, safe and practical open/close device which can be used to open and remove the cover promptly. It is absolutely different from a conventional hook stick manhole opener. The combined use of restrainable manhole or handhole cover along with its open/close device can not only protect manhole and handhole covers from theft but also minimize traffic accident.

BRIEF DESCRIPTION OF THE DRAWINGS

The drawings disclose an illustrastrative embodiment of the present invention which serves to exemplify the various advantages and objects hereof, and are as follows.

DETAILED DESCRIPTION OF THE PREFERRED EMBODIMENT

Figure 1:
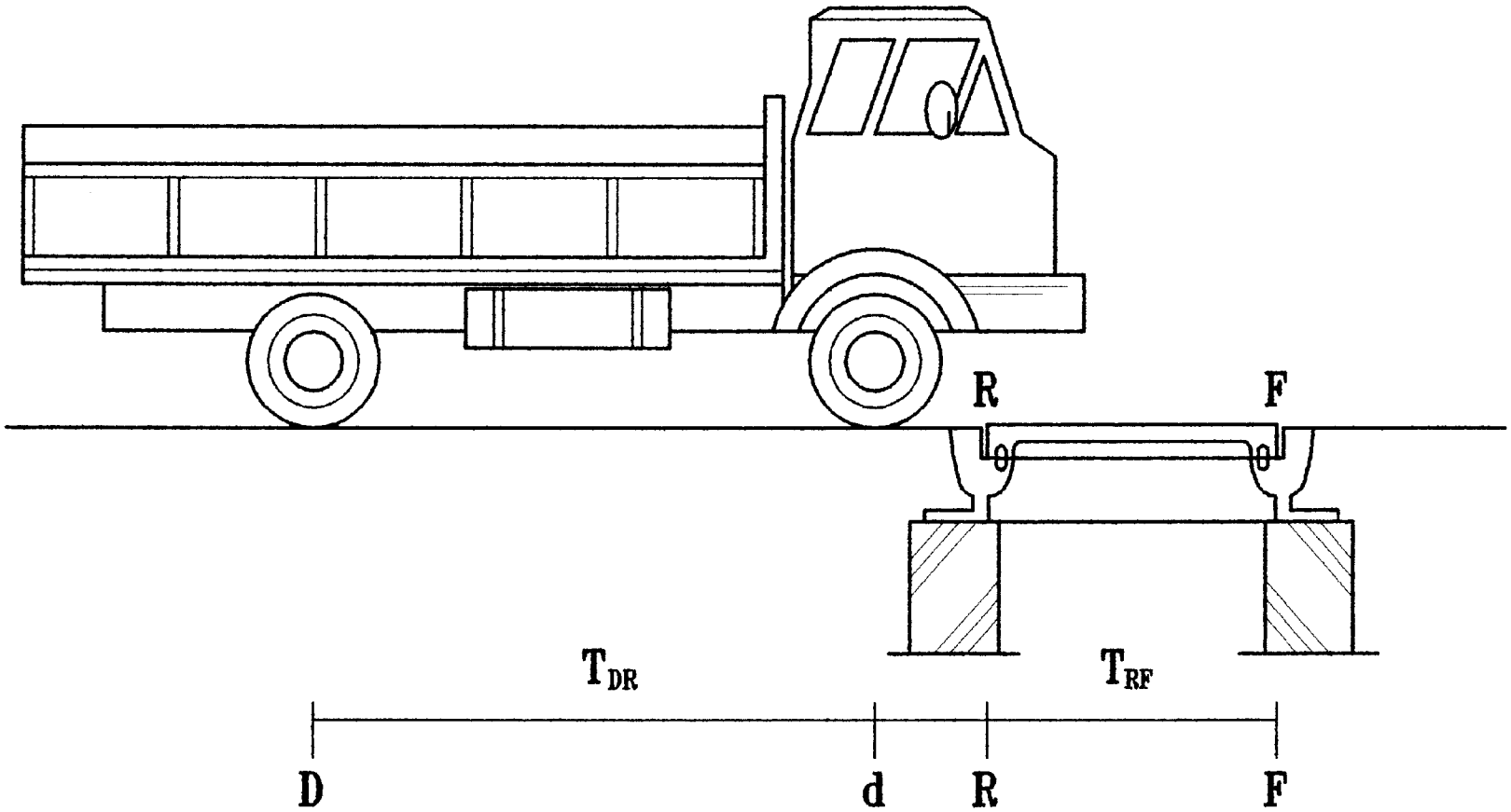
PRIOR ART FIG. 1
FIG. 1 is a drawing illustrating a conventional manhole or handhole cover which is about to be overlaid by a truck wheel (state 1)
Figure 2:
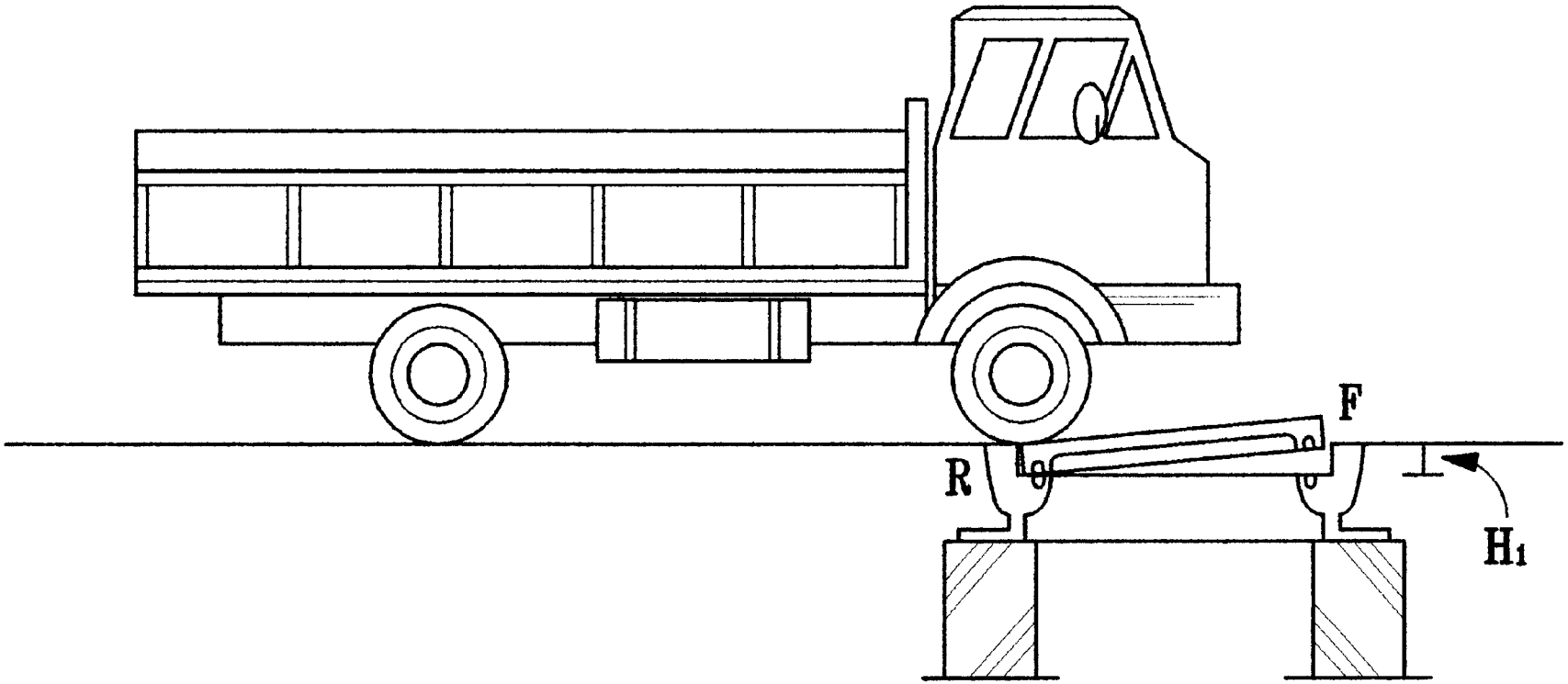
FIG. 2 is a drawing illustrating a convention manhole or handhole cover whose rear end has been overlaid by the front wheel of a truck (state 2)
Figure 3:
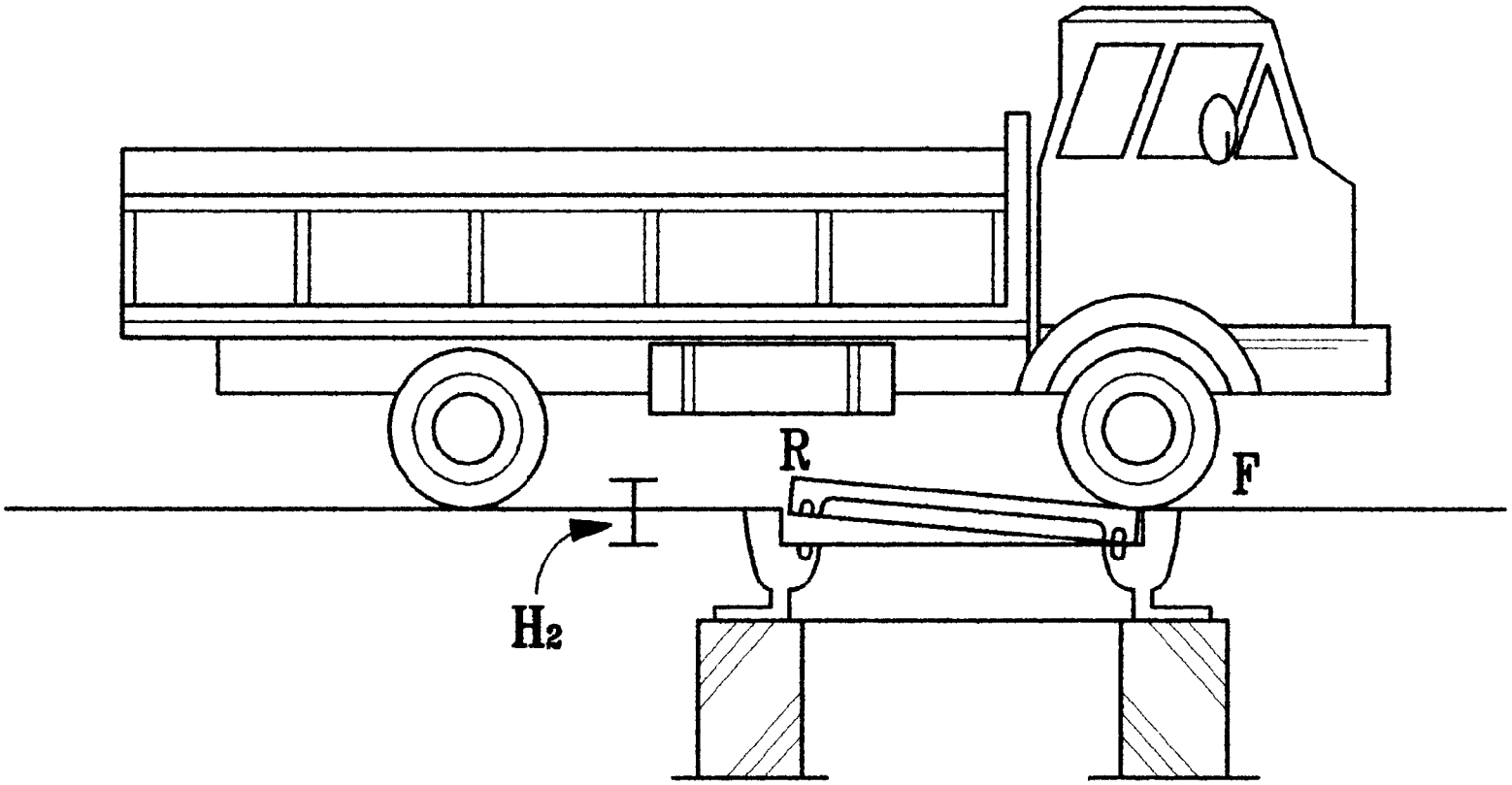
PRIOR ART FIG. 3
FIG. 3 is a drawing illustrating a conventional manhole or handhole cover whose rear end being bounced up (state 3)
Figure 4:
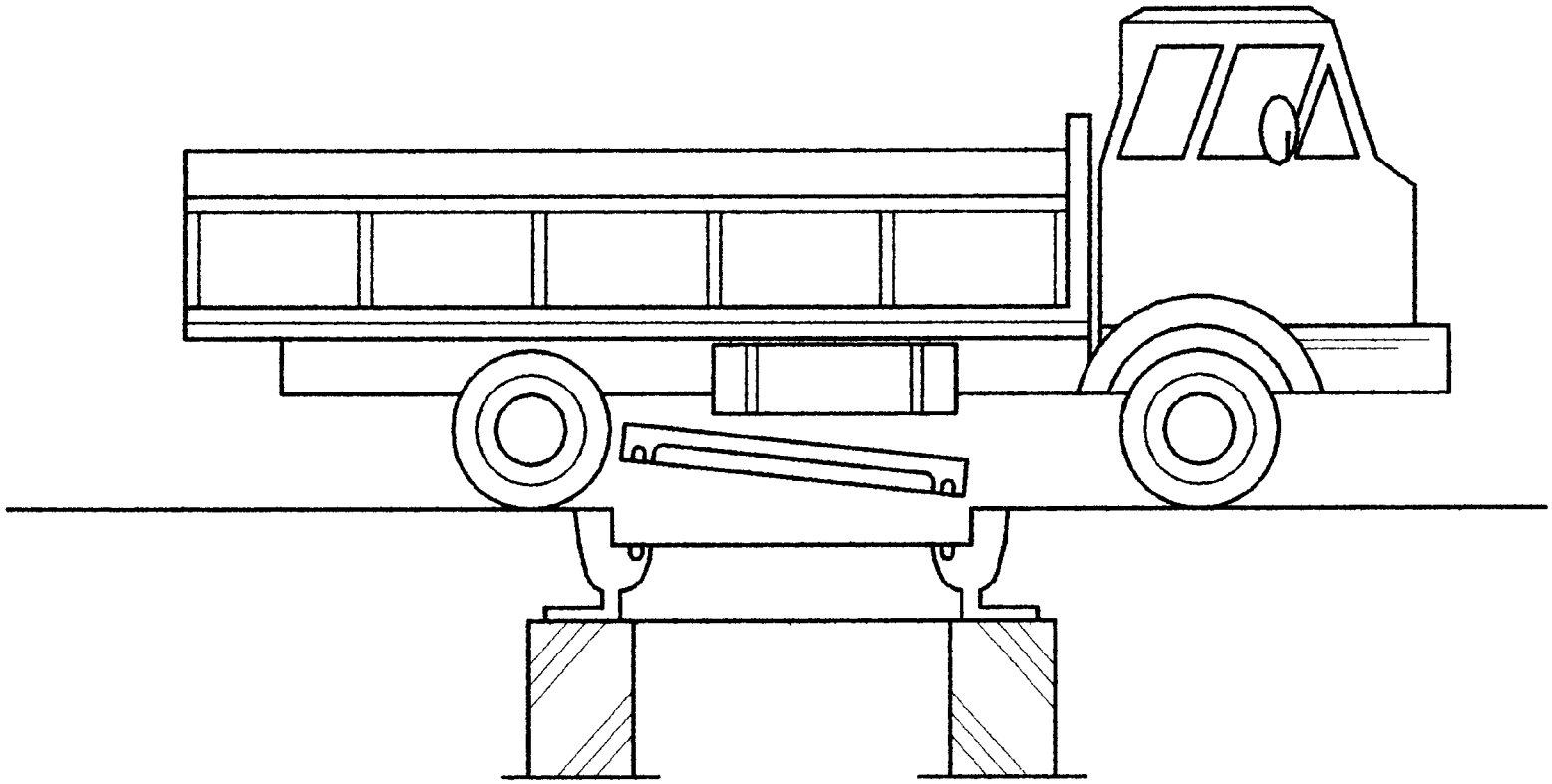
PRIOR ART FIG. 4
FIG. 4 is a drawing illustrating a conventional manhole or handhole cover jumping up or being thrown to the road surface by the rear wheel of a truck.
Figure 5:
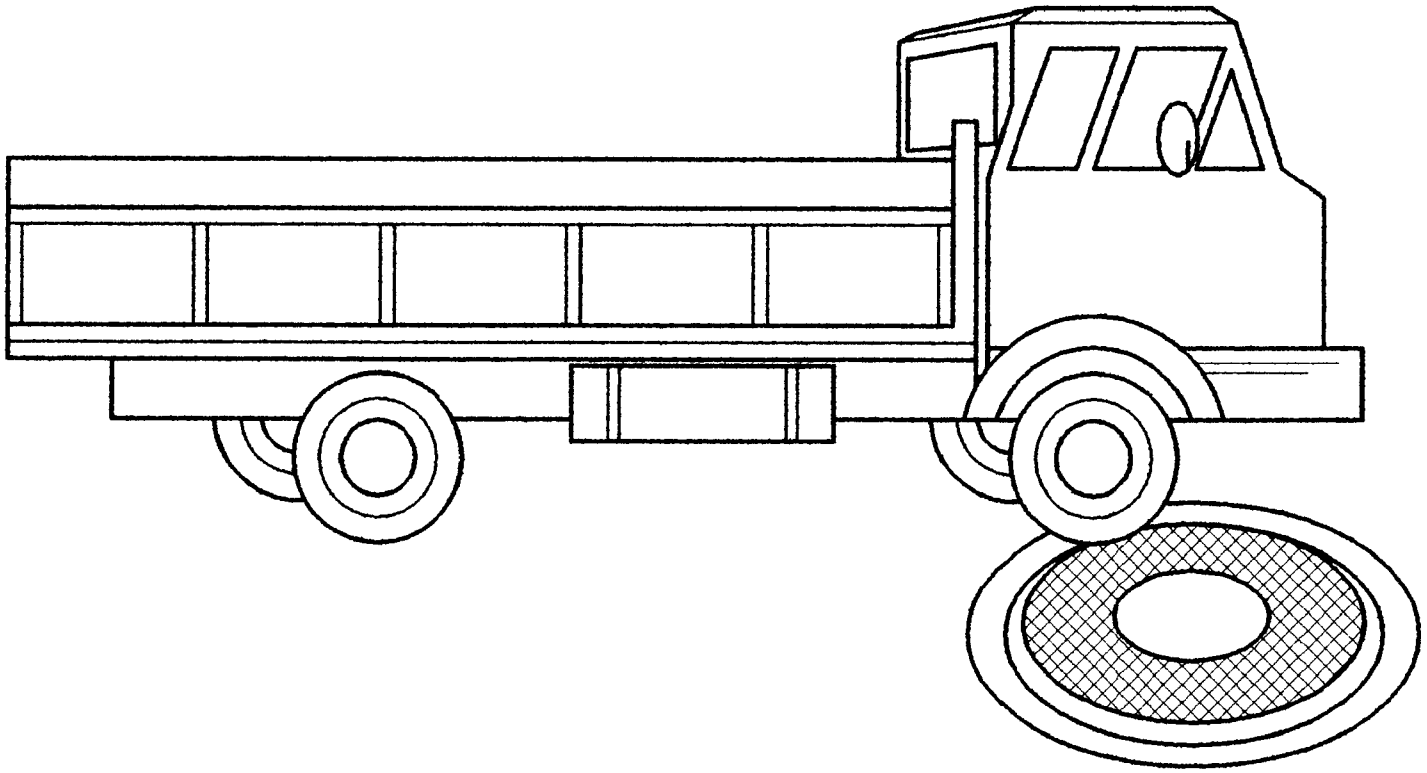
PRIOR ART FIG. 5
FIG. 5 is a drawing illustrating a conventional manhole or handhole cover which being about to be whirling away from its location (state 1)
Figure 6:
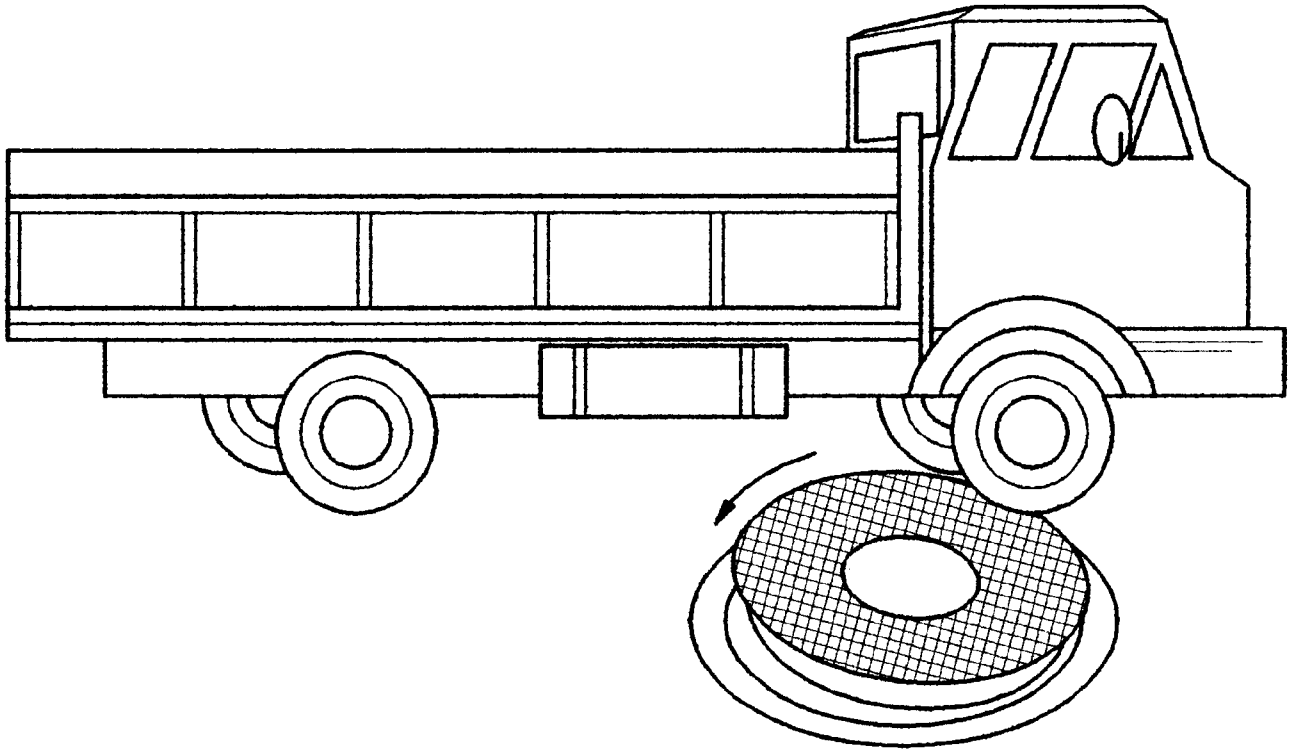
PRIOR ART FIG. 6
FIG. 6 is a drawing illustrating a conventional manhole or handhole cover which is whirling counter clockwise away from its location (state 2)
Figure 7:
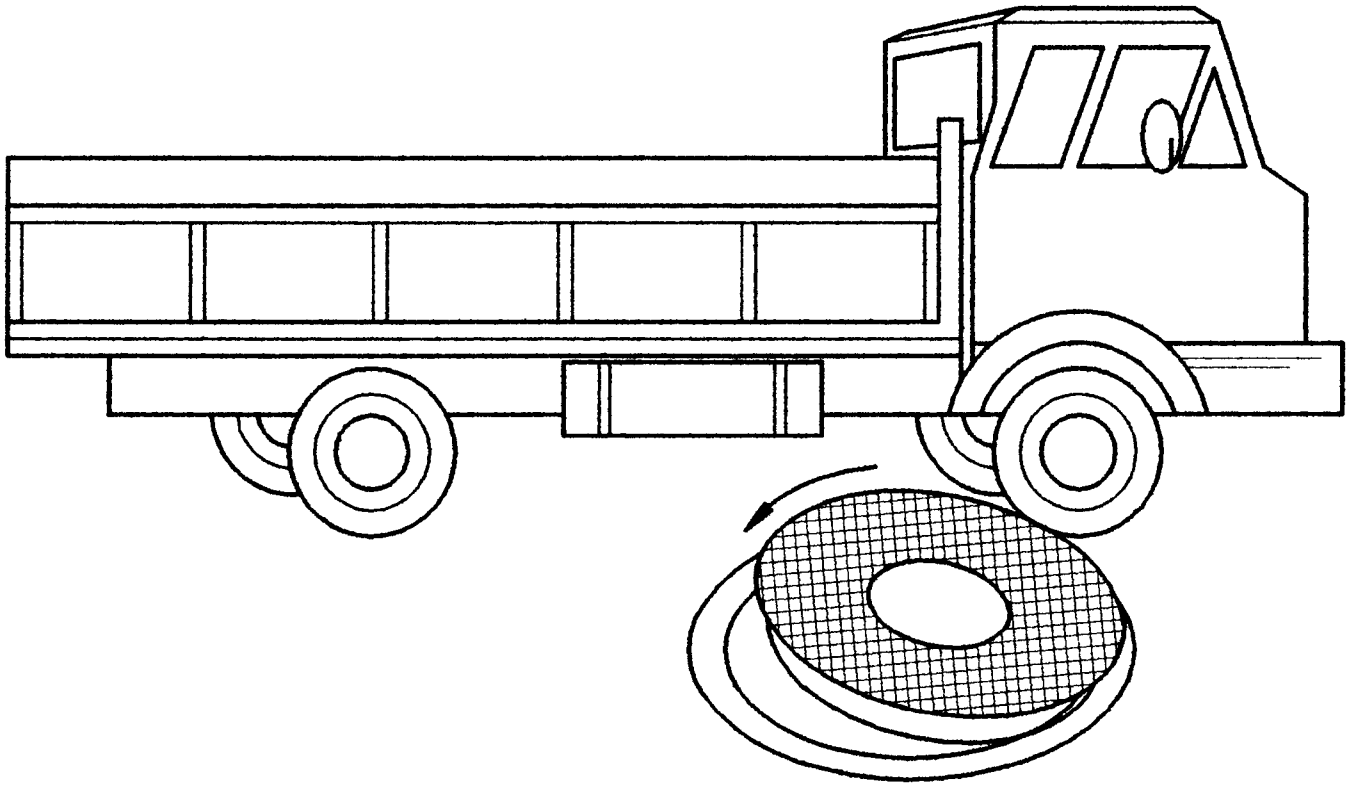
PRIOR ART FIG. 7
FIG. 7 is another drawing illustrating a conventional manhole or handhole cover which is whirling counter clockwise away from its location (state 3)
Figure 8:
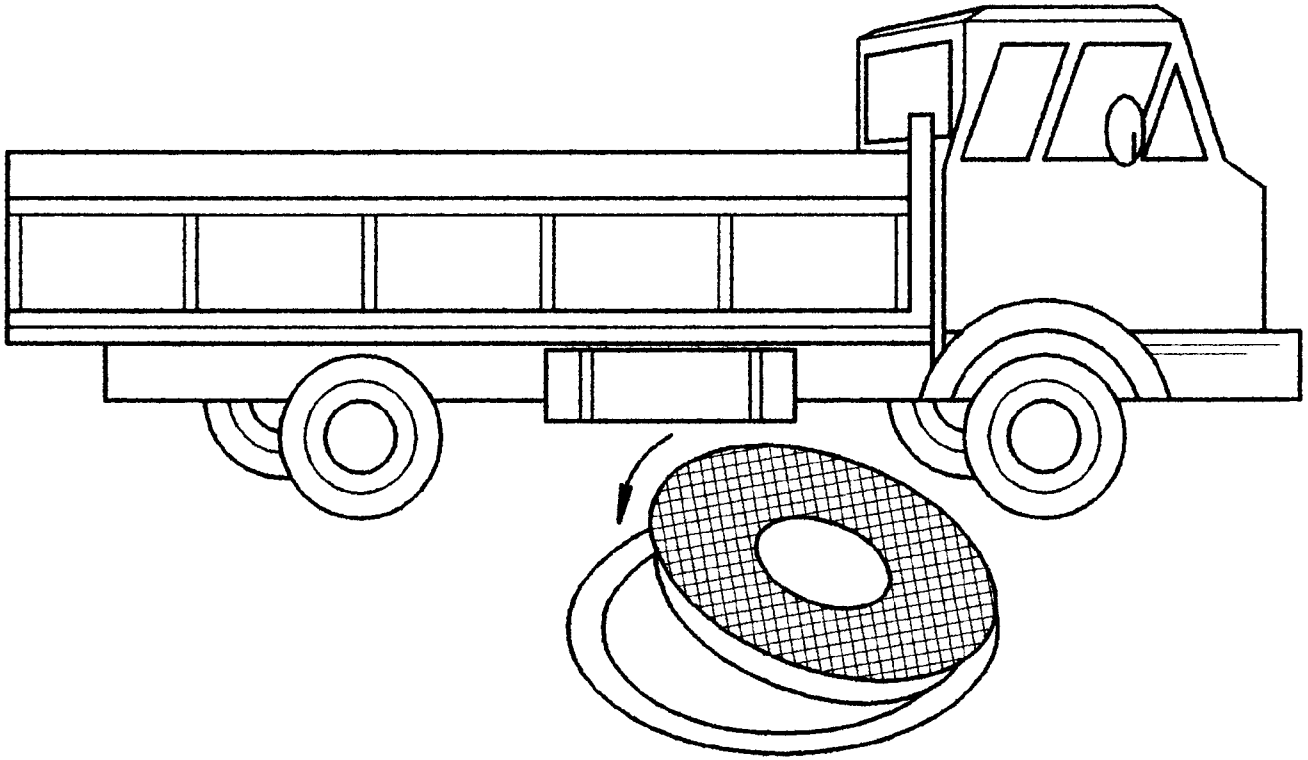
FIG. 8 is a drawing illustrating a conventional manhole or handhole cover which bounces up higher than before while keeps whirling counter clockwise (state 4)
Figure 9:
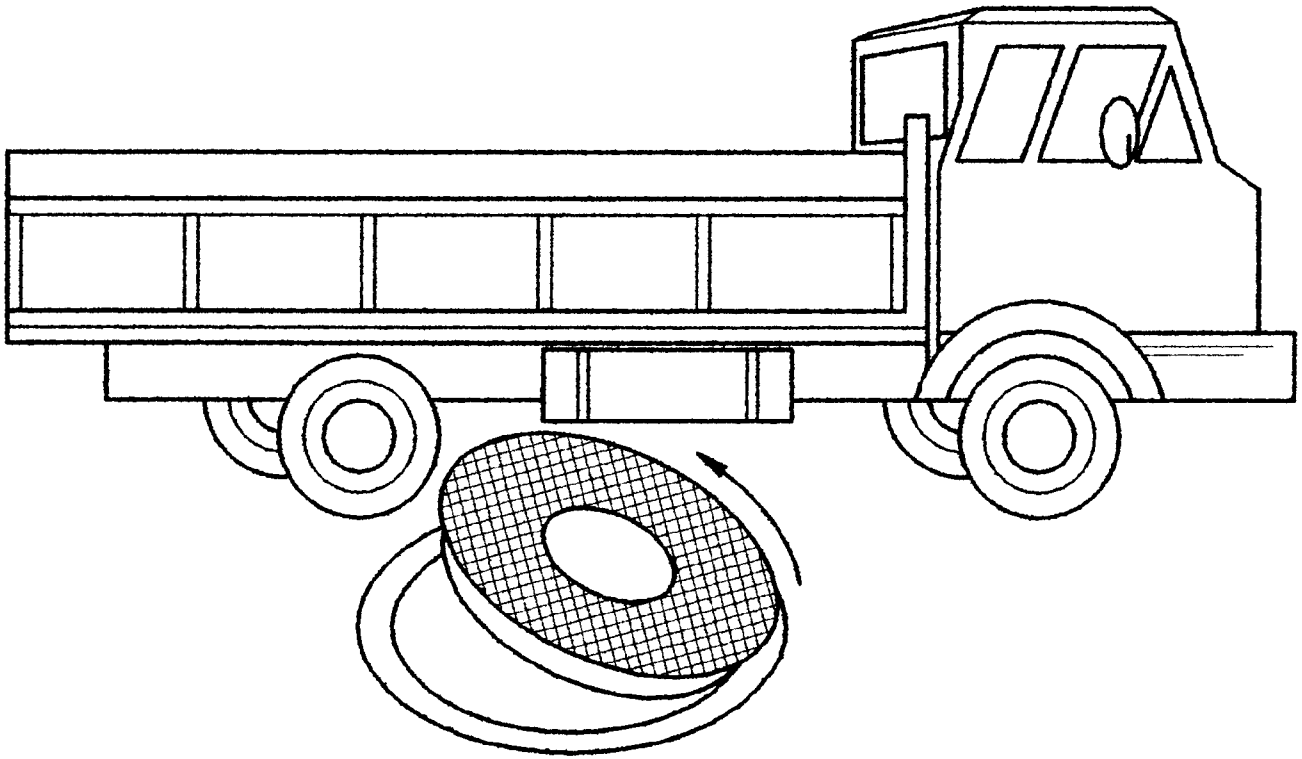
PRIOR ART FIG. 9
FIG. 9 is a drawing illustrating a conventional manhole or handhole cover which bounces up higher than the state 4 shown in FIG. 8, while keeps whirling counter clockwise (state 5)
Figure 10:
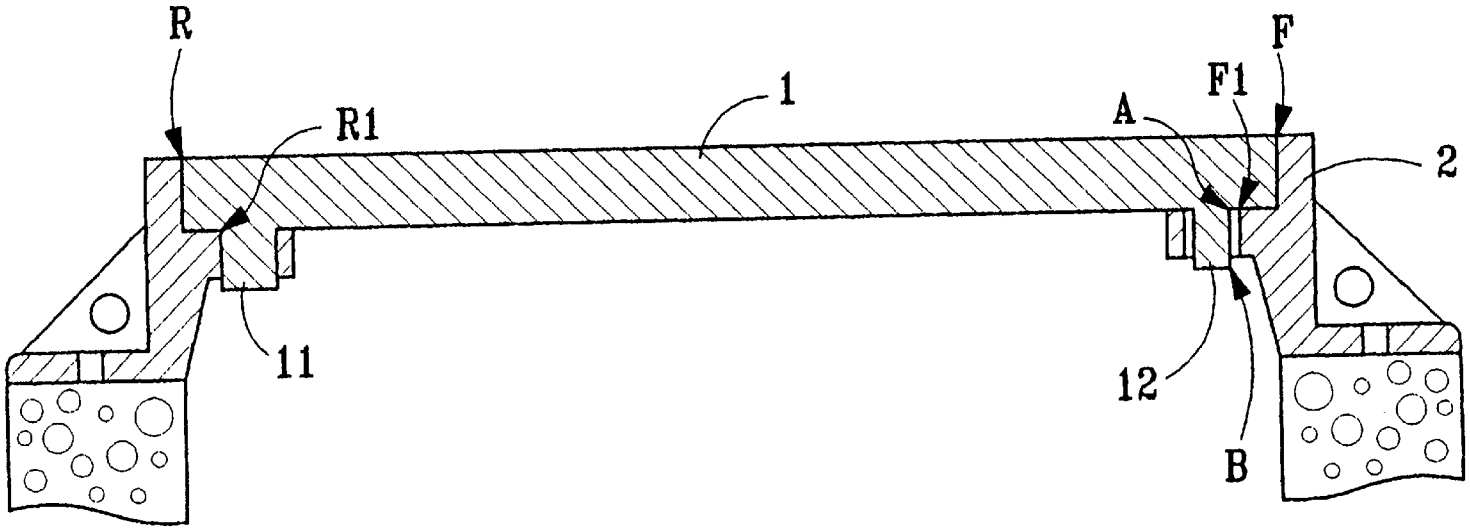
FIG. 10 is a drawing of a manhole or a handhole cover in an embodiment of the present invention.
Figure 11:
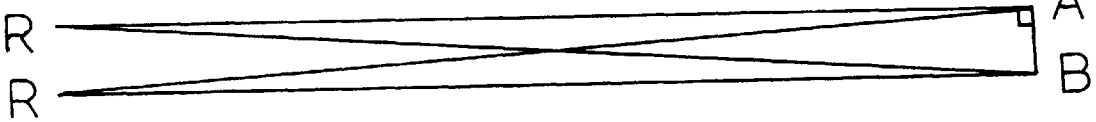
FIG. 11 is a drawing illustrating the functional principle of FIG. 10.

Referring to FIG. 10 and 11, restrainable manhole or handhole cover of the present invention comprises two vertical pads 11 and another two vertical pads 12, all being molded at the same time with the cover body 1 at proper positions along the bottom edge of the manhole or handhole cover 1. The vertex B of vertical pad 11 and the front end R of the cover 1 form a inclined third edge $\overline{RB}$. According to pythagoras theorem, $\overline{RB}$=

$$\text{According to Pythagoras' theorem, } \overline{RB} = \sqrt{\overline{RA}^2 + \overline{AB}^2},$$

$$\text{in which } \overline{RB} > \overline{RA} > \overline{R_1F_1}$$

in which $\overline{RB}>\overline{RA}>\overline{R_1F_1}$ (inner diameter of a manhole or a handhole neck).

Accordingly, when the front wheel of a vehicle overlays the end R, the vertical pads 11 of the cover 1 is restrained by the manhole or handhole neck 2 along the line AB so as to prevent bouncing of cover 1.

Figure 12A:
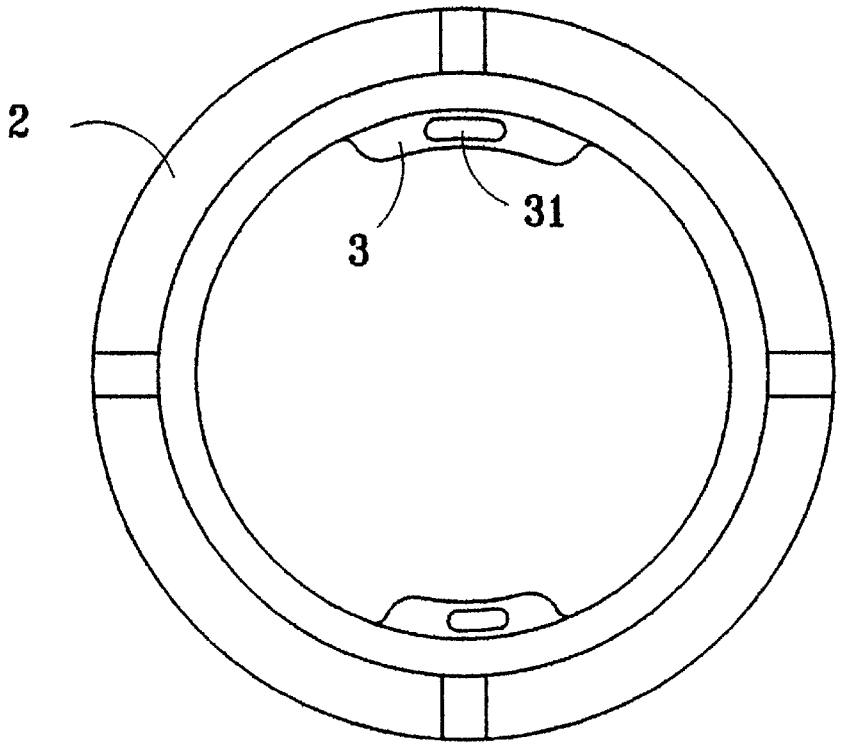
FIG. 12A is a plan view of a manhole or a handhole neck of the present invention.
Figure 12B:
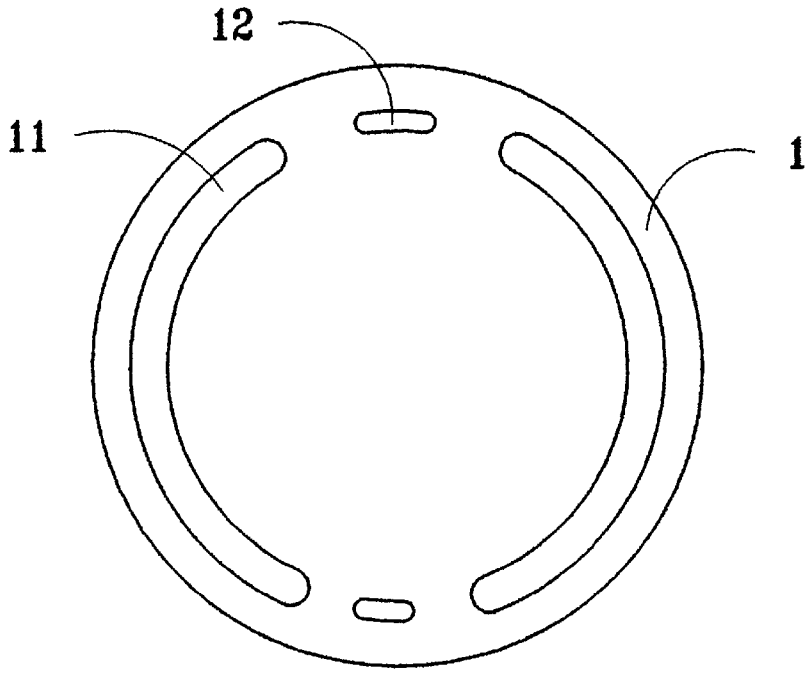
FIG. 12B is a plan view of a manhole or a handhole cover of the present invention.
Figure 13:
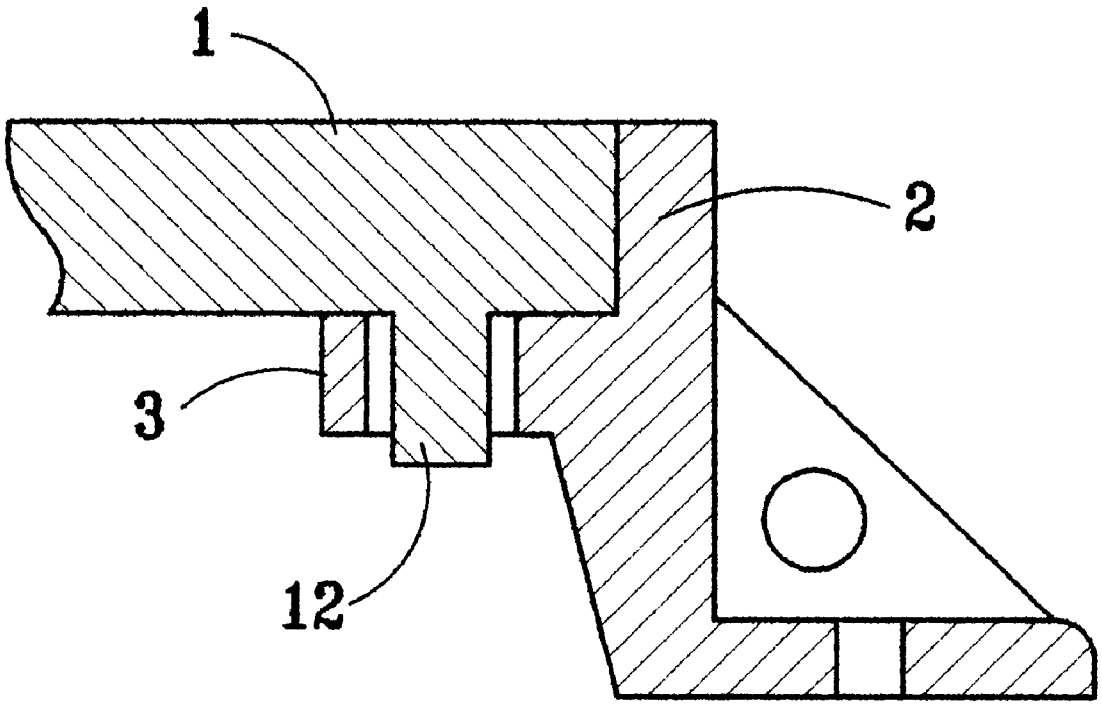
FIG. 13 is a fragmentary enlarged view showing the coupling relation between a manhole or a handhole cover and neck in an embodiment of the present invention.

Referring to FIG. 12A, 12B and 13, two flat plates 3 are pre-molded vertically at proper positions on neck 2, a pre-punched hole 31 is provided for each flat plate 3 for accepting the vertical pad 12 of the cover 1 to produce restraining effect. By means of such a construction, when a vehicle overlays a manhole or handhole cover, the pulling or compressive force exerted on the cover 1 by the front wheel is restrained so that the removal of cover 1 due to bouncing or whirling can be presented.

Figure 14A:
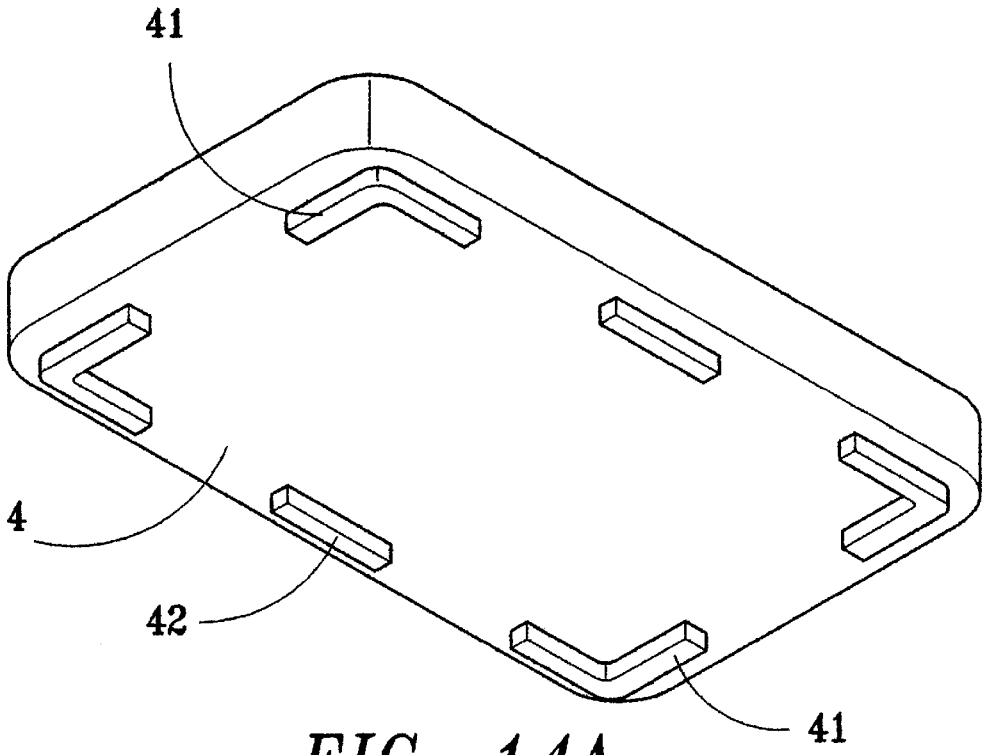
FIG. 14A is a drawing of a handhole cover in another embodiment of the present invention.
Figure 14B:
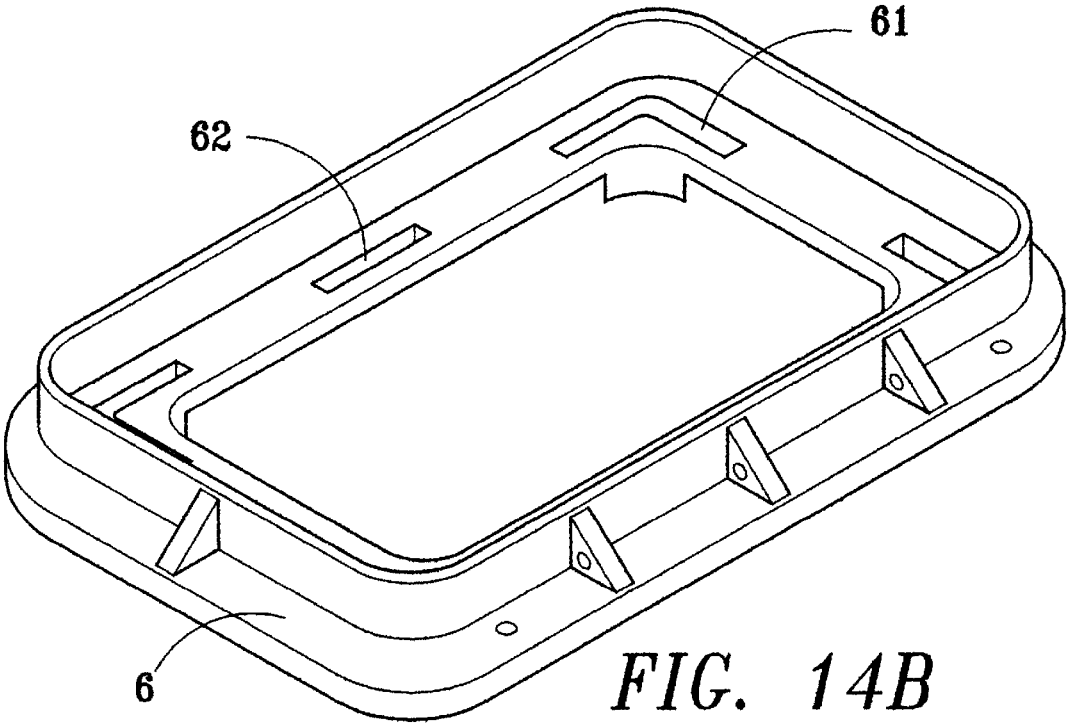
FIG. 14B is a drawing of a handhole neck in another embodiment of the present invention.

Referring to FIGS. 14A and 14B, the present invention further comprises a L shaped vertical pad 41 on each bottom comer of a rectangular handhole cover 4 to enhance its restrainability. In case the handhole cover 4 is too long, a vertical pad 42 may be added to each of the long edge to prevent deformation of the handhole cover 4 when a heavy vehicle overlays the handhole cover 4. In addition, provision of the vertical pads 41, 42 restrains bouncing of the handhole cover 4. Furthermore a L shaped restraining slot 61 is provided for each corner of the handhole neck 6, and a fixing slot 62 is provided for each long edge. With such construction the handhole cover 4 is restrained by the L shaped restraining slot 61 provided at each corner of the handhole neck 6, the restraining effect may be further enhanced by inserting the vertical pads 42 added to the two long edges of the handhole cover 4 into the fixing slots 62 of the handhole neck 6.

There is an adequate working space reserved between the adjacent vertical pads 11, 12 and 41 so as to protect the working personnel from injuring their feet during working with manhole and handhole covers 1 and 4.

Figure 15:
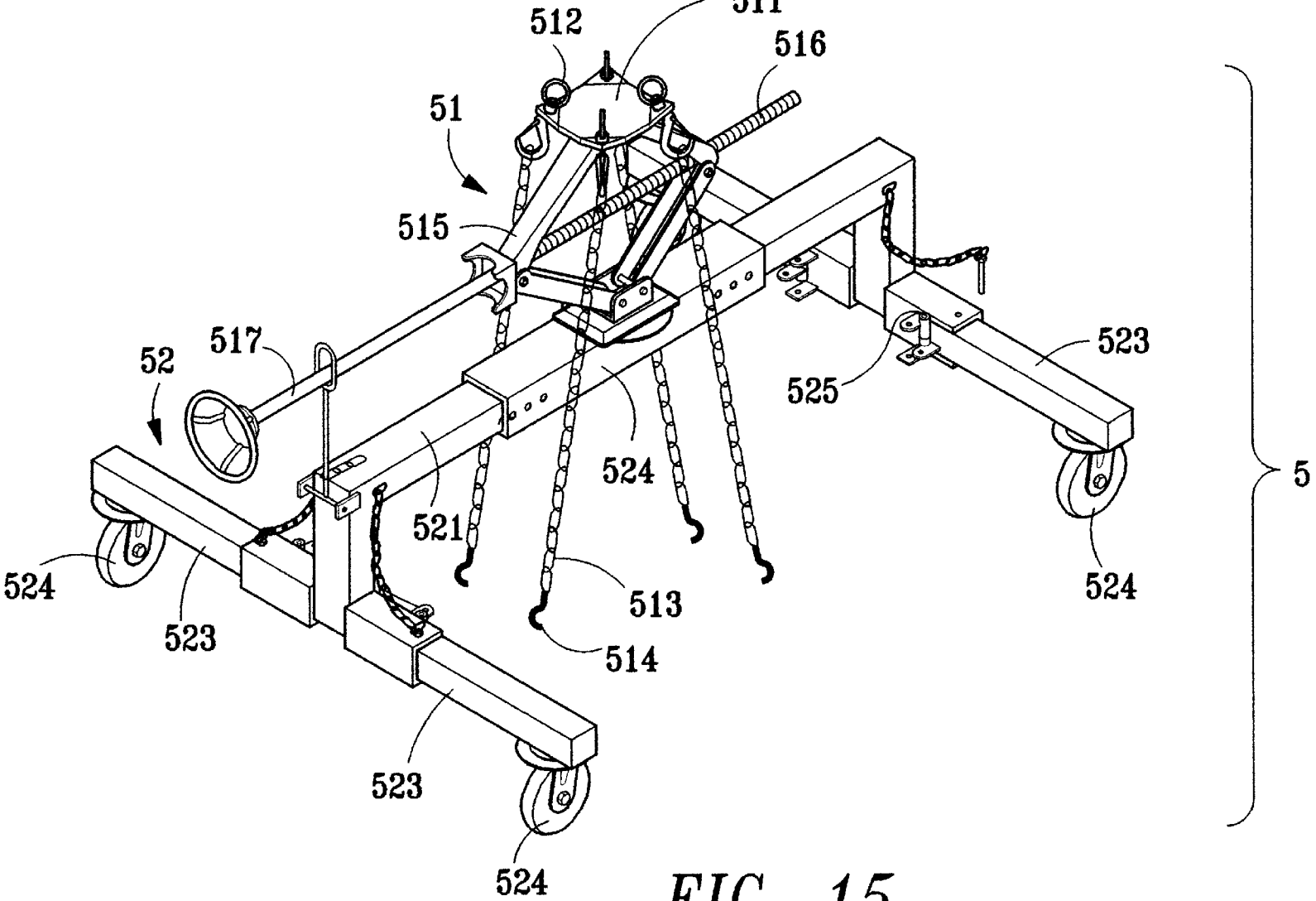
FIG. 15 is a three dimensional drawing of the manhole open/close device according to the present invention.
Figure 15A:
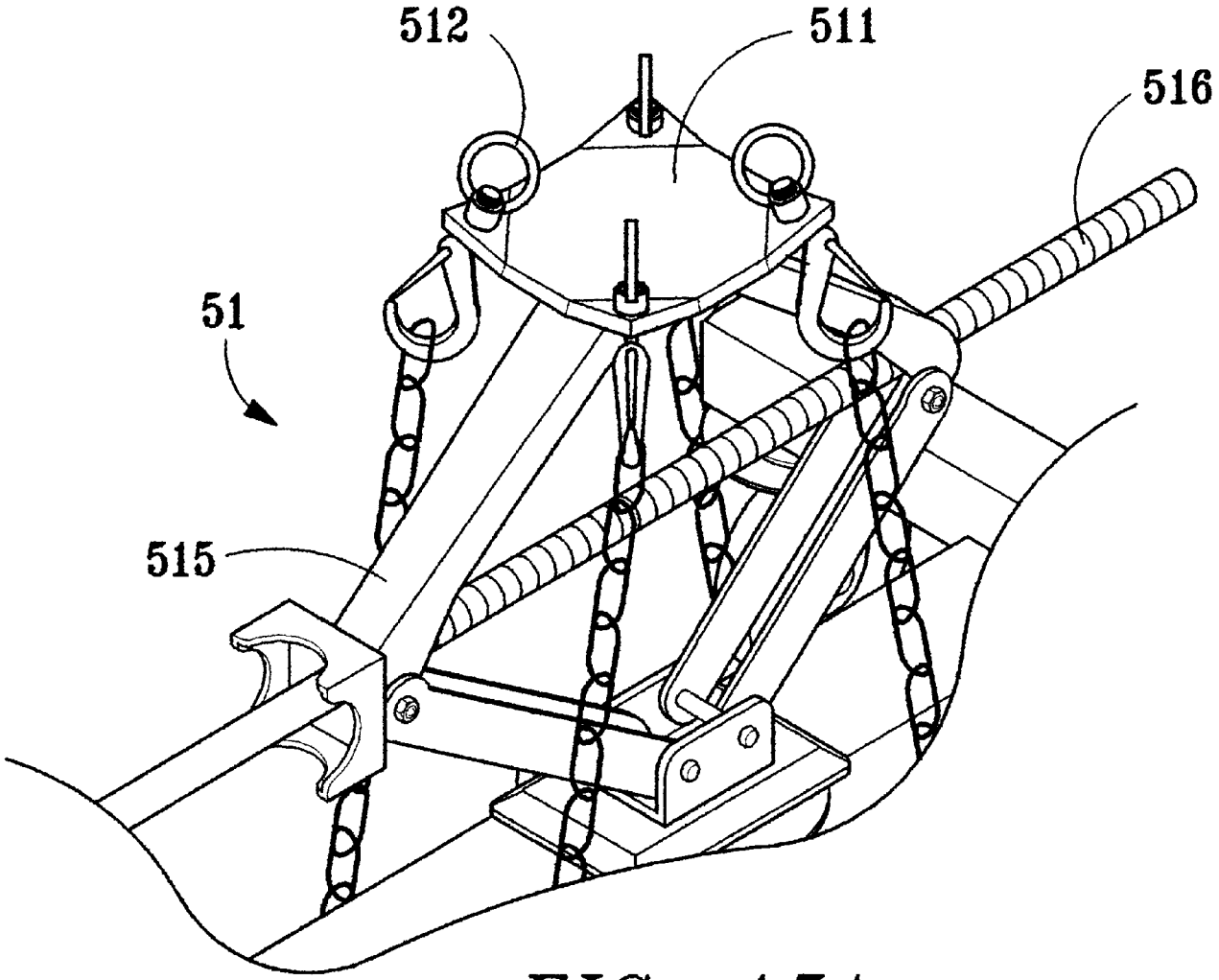
FIG. 15A is a partially enlarged drawing of the manhole open/close device according to the present invention.

Referring to FIGS. 15 and 15A, the present invention provides an open/close device 5 for the convenience of opening/closing the manhole or handhole cover, the open/close device 5 is composed of a jack 51 and a mobile apparatus 52. A flat platform 511 is provided on the jack 51. The four corners of the platform 511 are bent upward with an appropriate width and angle, and each corner is provided with a screw hole for combining with a screw bolt 512. A chain 513 is installed at the other end of each screw bolt 512, and a hanger hook 514 is provided it lower end of each chain 513. By adjusting each screw bolt 512 to keep balance the gravity center of a manhole or a handhole cover, the vertical open/close operation of a cover 1, 4 can be easily achieved. There is a four bar linkage 515 provided under the platform 511, a screw rod 516 penetrates through two opposite joins of the four bar linkage 515, and an operation rod 517 is connected to the other end of the crew rod 516. The mobile apparatus 52 includes a cross beam 521 for connecting with the four bar linkage 515 so as to support the jack 51. A supporting feet 523 is connected to each of the both ends of the cross beam 521 respectively, and a castor 524 is installed at each of the both ends of each supporting foot 523 respectively.

Figure 16:
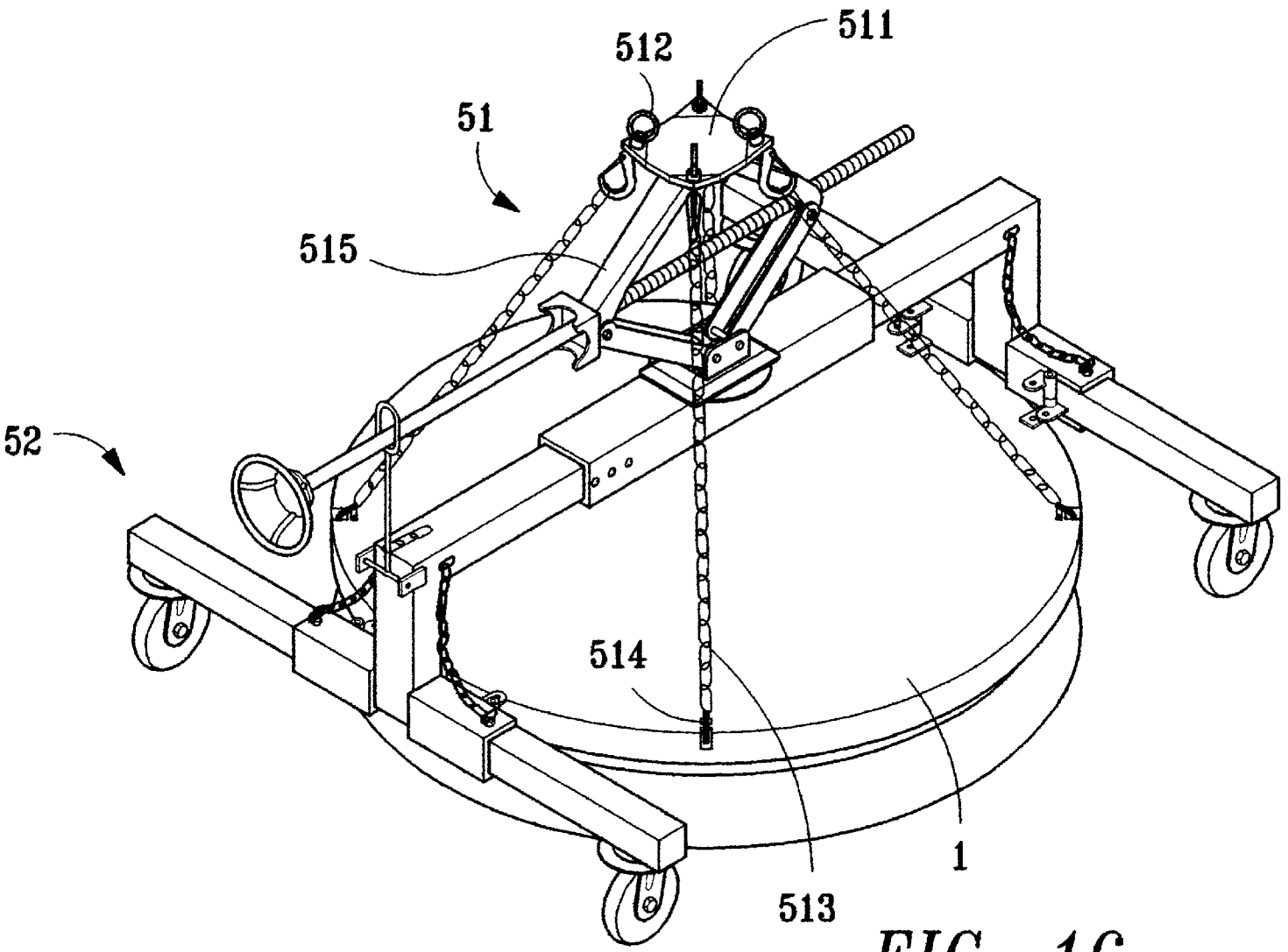
FIG. 16 is a drawing of the manhole open/close device in an embodiment of the present invention.
Figure 17:
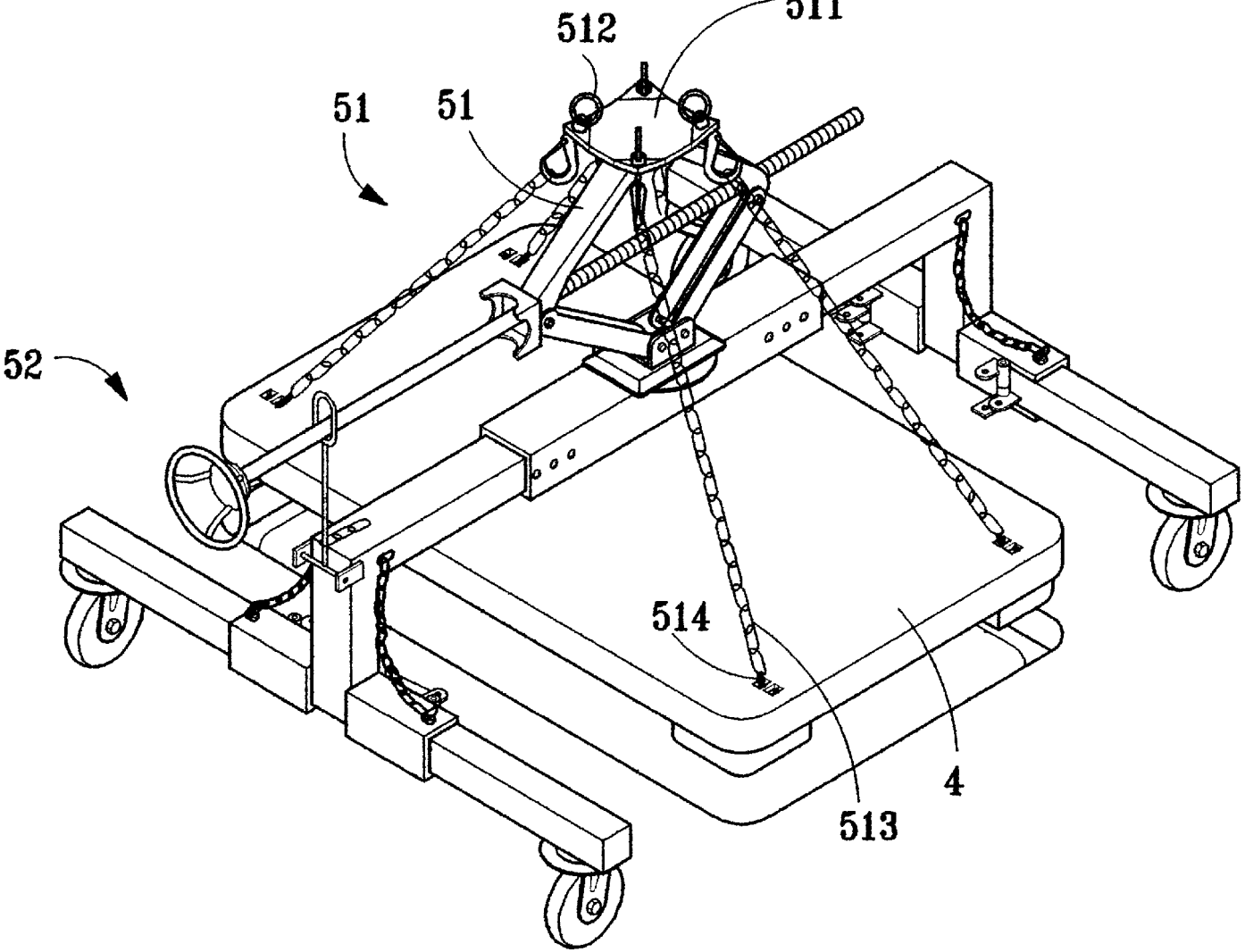
FIG. 17 is a drawing of the manhole open/close device in another embodiment of the present invention.

Referring to FIG. 16 and 17, for operation of the manhole open/close device 5 of the present invention; hooking on along the edge of the manhole or handhole cover 1 or 2 with hanging hook 514; adjusting the gravity center of the manhole or handhole cover 1 or 2 by screwing the screw bolt 512; and uplifting the four bar linkage 515 by screwing the operation rod 517 with the screw rod 516. By means of Lever Law, the heavy manhole or handhole cover 1, 2 may be removed with less force.

Figure 18:
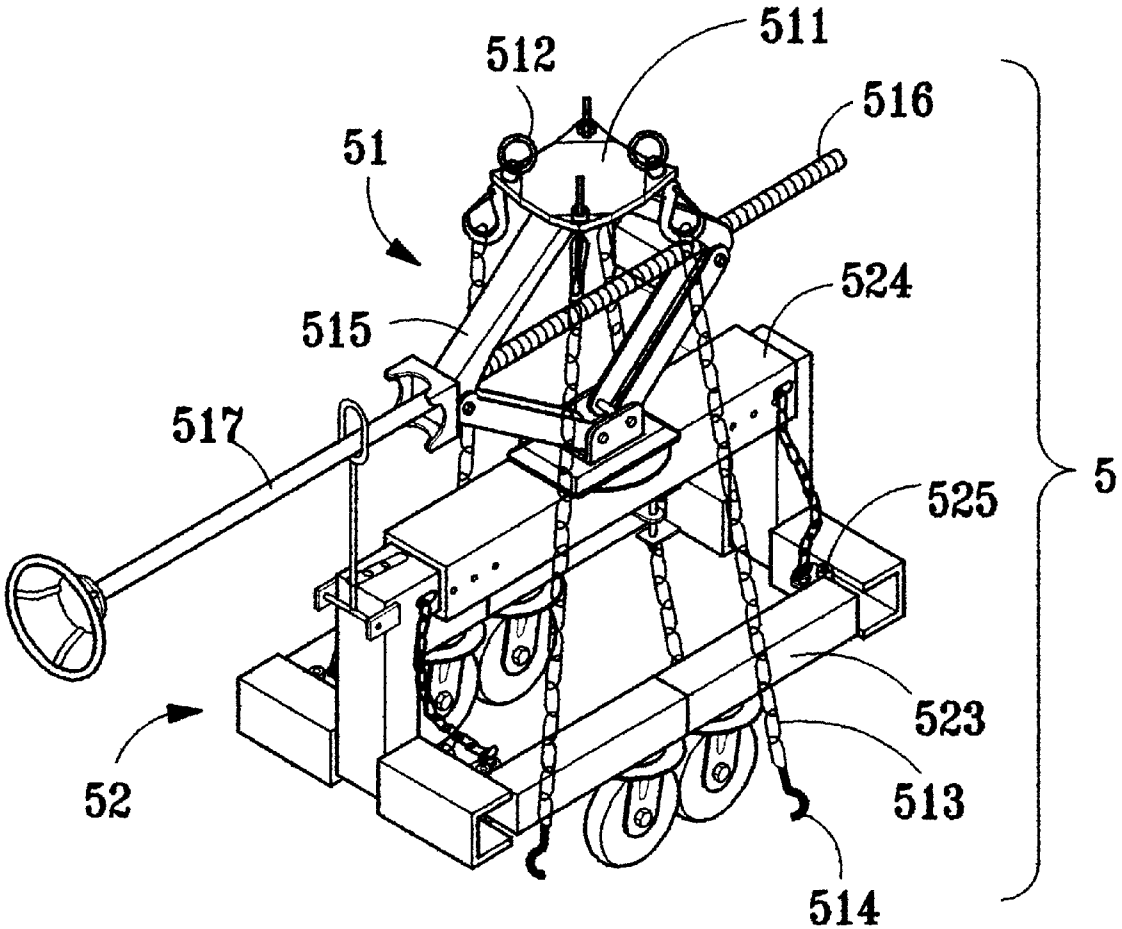
FIG. 18 is an explanatory diagram showing folding the manhole open/close device of the present invention.

Referring to FIG. 18, the present invention provides a contractible tube 524 on the cross beam 521 for accommodating the cross beam 521 from its both sides, and a rotating shaft 525 is provided for each supporting foot 523 so that it may bend inward along the rotating shaft for facilitating folding of the manhole open/close device.

Figure 19:
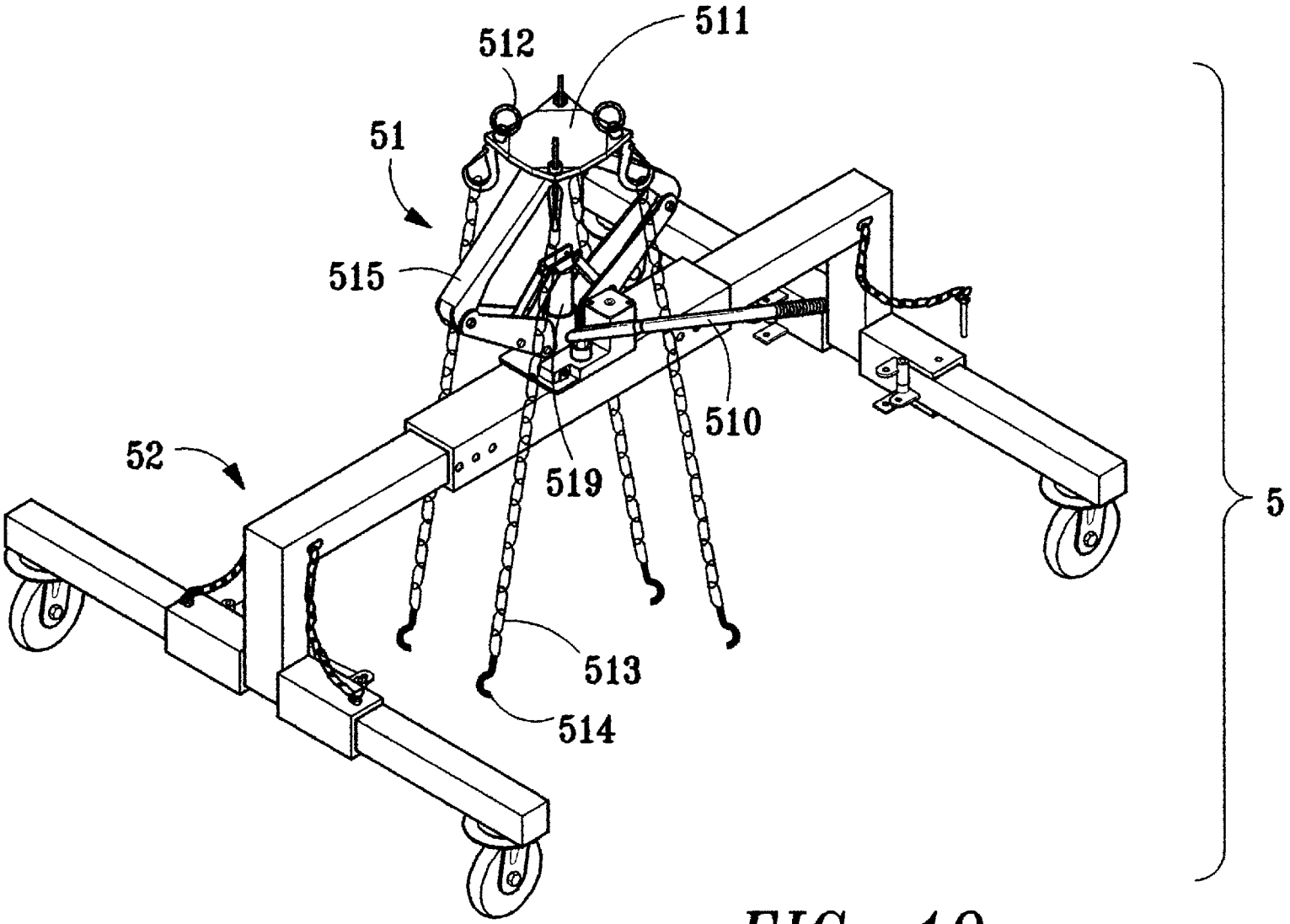
FIG. 19 is an explanatory diagram showing how a screw rod and an operation rod are replaced by a oil pressure jack for the manhole open/close device according to the present invention.

Referring to FIG. 19, the screw rod 516 and to operation rod 517 for the manhole open/close device 5 of the present invention may be replaced by an oil pressure cylinder 519. By controlling ascending and descending 52 motion of the oil pressure cylinder 519 with a force exerting arm 510, hanging and removing of the manhole or handhole cover 1, 2 may be easily accomplished.

Many changes and modifications in the above described embodiment of the invention can, of course, be carried out without departing from the scope thereof. Accordingly, to promote the progress in science and the use the arts, the invention is disclosed and is intended to be limited only by the scope of the appended claims.

What is claimed is:

1. A restrainable manhole/handhole cover and an open/close device therewith, wherein:

said restrainable manhole/handhole cover comprises a pair of first vertical pads and a pair of second vertical pads integrally molded with a cover body at predetermined positions along a bottom edge of said cover body, wherein a vertex of said pair of first vertical pads and a front end of said cover body forming an inclined third edge having a length longer than an inner diameter of a handhole neck; and said open/close device comprises a jack and a mobile apparatus, wherein a flat platform is provided on said jack, four corners of said platform is bent upward with a predetermined width and angle, each of said corners has a screw hole to assemble with a screw bolt, a chain is installed at one end of each of said screw bolts, and a hanger hook is connected at a lower end of each of said chains, wherein a four bar linkage is provided under said platform and a screw rod penetrates through two opposite joints of said four bar linkage, wherein one end of said screw rod is connected with an operation rod, moreover said mobile apparatus includes a cross beam connected with said four bar linkage so as to support said jack, wherein said cross beam has two ends each connecting with a supporting foot and each of said supporting feet has two ends each installing a castor thereto, whereby by using said jack, said manhole/handhole cover is capable of hanging up easily for removing from place to place by said mobile apparatus.

2. The restrainable manhole/handhole cover as recited in claim 1 wherein two flat plates are pre-molded vertically at predetermined positions on said handhole neck, and a pre-punched hole is provided for each of said flat plates to accept said respective second vertical pad of said cover body to produce a restraining effect.

3. The restrainable manhole/handhole cover as recited in claim 1 further comprising a rectangular handhole cover having four corners each having a L shaped vertical pad molded thereon, wherein said handhole neck has four L shaped restraining slots provided at four corners thereof.

4. The restrainable manhole/handhole cover as recited in claim 3, further comprising two vertical pad are added to two long edges of said handhole cover.

5. The open/close device as recited in claim 1 further comprising a contractible tube provided on said cross beam for accommodating said cross beam from both sides thereof, and a rotating shaft provided for each of said supporting feet so as to enable said supporting feet to bend inwardly along said rotating shafts respectively.

6. A restrainable manhole/handhole cover and an open/close device therewith, wherein:

said restrainable manhole/handhole cover comprises a pair of first vertical pads and a pair of second vertical pads integrally molded with a cover body at predetermined positions along a bottom edge of said cover body, wherein a vertex of said pair of first vertical pads and a front end of said cover body forming an inclined third edge having a length longer than an inner diameter of a handhole neck; and said open/close device comprises a jack and a mobile apparatus, wherein a flat platform is provided on said jack, four corners of said platform is bent upward with a predetermined width and angle, each of said corners has a screw hole to assemble with a screw bolt, a chain is installed at one end of each of said screw bolts, and a hanger hook is connected at a lower end of each of said chains, wherein a four bar linkage is provided under said platform and an oil pressure cylinder with a force exerting arm penetrates through two opposite joints of said four bar linkage, wherein said mobile apparatus includes a cross beam connected with said four bar linkage so as to support said jack, wherein said cross beam has two ends each connecting with a supporting foot and each of said supporting feet has two ends each installing a castor thereto, whereby by using said jack, said manhole/handhole cover is capable of hanging up easily for removing from place to place by said mobile apparatus.

7. The restrainable manhole/handhole cover as recited in claim 6 wherein two flat plates are pre-molded vertically at predetermined positions on said handhole neck, and a pre-punched hole is provided for each of said flat plates to accept said respective second vertical pad of said cover body to produce a restraining effect.

8. The restrainable manhole/handhole cover as recited in claim 6 further comprising a rectangular handhole cover having four corners each having a L shaped vertical pad molded thereon, wherein said handhole neck has four L shaped restraining slots provided at four corners thereof.

9. The restrainable manhole/handhole cover as recited in claim 8 further comprising two vertical pad are added to two long edges of said handhole cover.

10. The open/close device as recited in claim 6 further comprising a contractible tube provided on said cross beam for accommodating said cross beam from both sides thereof, and a rotating shaft provided for each of said supporting feet so as to enable said supporting feet to bend inwardly along said rotating shafts respectively.

* * * * *